US005292607A

United States Patent [19]

Aso et al.

[11] Patent Number: 5,292,607

[45] Date of Patent: Mar. 8, 1994

[54] ELECTROPHOTOGRAPHIC PHOTORECEPTOR CONTAINING POLYCARBONATE RESIN AS A BINDER AND METHOD FOR PREPARATION THEREOF

[75] Inventors: Ryoko Aso; Michio Kawai, both of Yokohama; Osamu Murakami, Machida; Mamoru Nozomi, Yokohama; Ryuji Nakayama, Sagamihara; Tadashi Umehara, Odawara, all of Japan

[73] Assignee: Mitsubishi Kasei Corporation, Tokyo, Japan

[21] Appl. No.: 965,929

[22] Filed: Oct. 22, 1992

[30] Foreign Application Priority Data

Oct. 22, 1991 [JP] Japan ..... 3-274279
Jul. 6, 1992 [JP] Japan ..... 4-178559

[51] Int. Cl.[5] ..... G03G 9/087
[52] U.S. Cl. ..... 430/96; 430/133
[58] Field of Search ..... 430/96, 57, 133

[56] References Cited

U.S. PATENT DOCUMENTS 5,039,584 8/1991 Odell et al. ..... 430/96
5,202,408 4/1993 Yanus et al. ..... 430/96

FOREIGN PATENT DOCUMENTS 032159 6/1991 Fed. Rep. of Germany .
63-40159 4/1988 Japan .
30-71143 7/1991 Japan .

*Primary Examiner*—John Goodrow

*Attorney, Agent, or Firm*—David G. Conlin; George W. Neuner

[57] ABSTRACT

A novel electrophotographic photoreceptor and a method of preparation therof are disclosed. The photoreceptor is characterized in that the photosensitive layer contain a specific carbonate resin binder resin having a weight average molecular weight on not less than 200,000. The resin is preferably a polycarbonate resin which contains repeating units represented by the formula

[I]

wherein $R^1$, $R^2$, $R^3$, $R^4$, $R^5$, $R^6$, $R^7$ and $R^8$ are respectively and independently a hydrogen atom, a lower alkyl group, a halogen atom or an unsubstituted or substituted aromatic group; and $R^9$ and $R^{10}$ are respectively and independently a hydrogen atom, a lower alkyl group, an unsubstituted or substituted aromatic group, or form a ring or a carbonyl group together with the linking carbon atom. The method is characterized in that the photosensitive layer contains a polyocarbonate having a weight average molecular weight of not less than 200,000 as a binder resin and is formed by spray coating or spiral coating.

16 Claims, No Drawings

ELECTROPHOTOGRAPHIC PHOTORECEPTOR CONTAINING POLYCARBONATE RESIN AS A BINDER AND METHOD FOR PREPARATION THEREOF

FIELD OF THE INVENTION

The present invention relates to an electrophotographic photoreceptor and a method for preparation thereof. More particularly, this invention relates to an electrophotographic photoreceptor having excellent printing durability (abrasion resistance) in which a polycarbonate resin having a particular average molecular weight is used as a binder and a method for preparation thereof.

BACKGROUND OF THE INVENTION

For photosensitive layers of the electrophotographic photoreceptor, inorganic photoconductive materials such as selenium, cadmium sulfide, zinc oxide, etc, have been generally used. However, they have defects. Selenium and cadmium sulfide are poisonous and they must be recovered after use. Selenium is inferior in heat resistance because it is crystallized by heat. Zinc oxide is inferior in moisture resistance and lacks printing durability. Therefore, many attempts are being made in development of new photoreceptors.

Recently, use of organic photoconductive materials for photosensitive layers of the electrophotographic photoreceptor has been studied and some of them now has come into practical use. Organic photoconductive materials have advantages in comparison with inorganic ones in that they are of light-weight, easily formable into a film and a photoreceptor and some of them can give transparent photoreceptor.

Although organic photoconductive materials have many such advantages, they are not widely used because they are inferior to inorganic ones in sensitivity and durability.

In the mean time, it was found that the so-called layered type photoreceptor comprising a charge generating layer and a charge transporting layer provided on an elctroconductive support is advantageous in enhancement of sensitivity and thus the layered type photoreceptor is the main stream of development, in which organic photosensitive materials have now come into use.

However, layered type photoreceptors now in practical use are inferior to inorganic photoreceptors in durability in particular. One of the elements which decide durability is physical properties. That is, organic photoreceptors are liable to suffer abrasion and scratching by development with toner, friction with paper, friction with a cleaning member (although load is different according to type of apparatuses), etc. Therefore, organic photoreceptors practically have only limited printing durability. In the layered type photoreceptor, it is generally the charge transporting layer that bears such load. A charge transporting layer usually comprises a binder resin and a charge transporting material and the strength of the layer depends on the binder. As the amount of the doped charge transporting material is considerably large, the layer is not provided with sufficient mechanical strength.

For charge transporting layers, polymers or copolymers of vinyl compounds such as styrene, vinyl acetate, vinyl chloride, acryl esters, methacryl esters, butadiene, etc. and thermoplastic and thermosetting resins such as polyvinylacetal, polycarbonate, polyester, polysulfone, poly(phenylene oxide), polyurethane, cellulose esters, cellulose ethers, phenoxy resins, silicon resins, epoxy resins, etc. are used as binders. Among many binder resins, polycarbonate resins have comparatively excellent properties and many kinds of polycarbonate resins have been developed and some are practically in use.

However, even these polycarbonate resins are still insufficient in abrasion resistance, scratch resistance, etc., especially in abrasion resistance when polycarbonate resins are used for the electrophotography and thus development of binder resins which are provided with excellent abrasion resistance is strongly desired.

The present invention was made in order to overcome the above-described problem and is intended to provide a binder resin which enables manufacturing of highly abrasion-resistant photoreceptors having excellent durability.

In this respect, we conducted an intensive study in search of binder resins which can provide durable electrophotographic photoreceptors and found that a particular polycarbonate resin having a weight average molecular weight of not less than 200,000.

In the mean time, photoreceptors are conventionally prepared by dip coating. For instance, a cylindrical substrate is dipped in a batch of a coating liquid. In this method, run (local flow-down) of the liquid on the coated surface is apt to occur. Also local nonuniformity in concentration of the coating liquid is caused in the batch. Thus it is difficult to form a coating layer of an even thickness. Generally, binder resins of higher molecular weights have higher viscosities and thus are liable to promote occurrence of the above-mentioned run and concentration nonuniformity. Generally, as the molecular weight of the binder resin increases, the viscosity thereof increases, and thus the coating liquid which contains the polycarbonate resin in accordance with this invention becomes viscous. Such a viscous coating liquid easily develop concentration nonuniformity and bubbling and that the once caused concentration uniformity and bubbles will not be remedied. The means to solve this problem is to reduce the solid content of the coating liquid. However, if the coating is effected with a coating liquid with a low solid concentration, the above-mentioned run is easier to occur when a cylinder is coated by dip coating since the solvent content in the wet coating is large. Therefore, it is not easy to form a photosensitive layer of even thickness from the coating liquid containing the polycarbonate resin having a weight average molecular weight not less than 200,000.

Thus we conducted an intensive study concerning method for forming photosensitive layer of uniform thickness from the above described polycarbonate resin of the present invention and found that spiral coating or spray coating is effective.

SUMMARY OF THE INVENTION

The gist of the present invention is to provide, in the electrophotographic photoreceptor having a photosensitive layer containing a photoconductive material and a binder on an electroconductive support, a photoreceptor whose photosensitive layer contains as a binder a polycarbonate resin which has a weight average molecular weight of not less than 200,000 and preferably is represented by the formula [I]

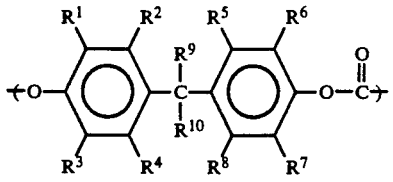

[I]

wherein $R^1$, $R^2$, $R^3$, $R^4$, $R^5$, $R^6$, $R^7$ and $R^8$ are respectively and independently a hydrogen atom, a lower alkyl group, a halogen atom or an unsubstituted or substituted aromatic group; and $R^9$ and $R^{10}$ are respectively and independently a hydrogen atom, a lower alkyl group, or an unsubstitued or substituted aromatic group or form a ring or a carbonyl group together with the linking carbon atom.

The gist of the present invention is also to provide, in the method for preparing an electrophotographic photoreceptor having a photosensitive layer on an electroconductive support, a method comprising forming a photosensitive layer containing as a binder a polycarbonate resin having a weight average molecular weight of not less than 200,000 by means of spray coating or spiral coating.

SPECIFIC DESCRIPTION OF THE INVENTION

The invention will now be specifically described.

The photoreceptor of the present invention is provided with a photosensitive layer containing one or more species of the repeating units represented by the above formula [I]and having a weight average molecular weight of not less than 200,000.

In the formula [I], $R^1$, $R^2$, $R^3$, $R^4$, $R^5$, $R^6$, $R^7$ and $R^8$ are respectively and independently a hydrogen atom, a lower alkyl group such as methyl, ethyl, iso-propyl, etc.; a halogen atom such as chlorine atom, bromine atom, etc. an unsubstituted or substituted aromatic group such as phenyl, naphthyl, tolyl, etc. and $R^9$ and $R^{10}$ are respectively and independently a hydrogen atom, a lower alkyl group such as methyl, ethyl, isopropyl, etc.; an unsubstituted or substituted aromatic group such as phenyl, naphthyl, tolyl, etc., or are connected to form a ring such as cyclohexane or form a carbonyl group together with the linking carbon atom.

The term "photosensitive layer" used herein means a single layer which contains photoconductive particles, which generate charge carriers at high efficiency when they absorb light, and a charge transporting material or a layered one comprising a charge generation layer which contains photoconductive particles as described above and a charge transporting layer which contains a charge transporting material.

Needless to say, a binder resin is used in all the layers. However, the above-described polycarbonate resin in accordance with the present invention should be contained at least in the outermost layer.

A sensitizing dye, an electron acceptor, a plasticizer, a pigment, etc. can be contained in a photosensitive layer.

In the case of single layer type photosensitive layer, the photoreceptor of the present invention can be prepared by dissolving a polycarbonate resin represented by the formula [I] and having a weight average molecular weight of not less than 200,000 alone or in combination with another known polymer having excellent properties as a binder in a suitable solvent together with a charge transporting material and photoconductive particles which generate charge carriers when they absorb light, and sensitizing dyes, electron acceptors, plasticizers, pigments and other additives if desired, applying the resulting solution or suspension on an electroconductive support and drying the coated layer.

In the case of a layered type photoreceptor, the photosensitive layer can be prepared by first forming a charge generation layer by applying a coating liquid comprising photoconductive particles which generate charge carriers when they absorb light and a known polymer having excellent properties as a binder in a suitable solvent, and sensitizing dyes, electron acceptors, plasticizers, pigments and other additives if desired, and then forming a charge transporting layer by applying a liquid which can be prepared by dissolving a polycarbonate resin represented by the formula [I] and having a weight average molecular weight of not less than 200,000 alone or in combination with anohter known polymer having excellent properties as a binder in a suitable solvent together with a charge transporting material, and electron acceptors.

Application of the liquid can be effected by any of dip coating, ring coating, spray coating, spiral coating, bar coating, etc. Because of high viscosity of the polycarbonate resin solution in accordance with the present invention, it is difficult to raise the concentration of the resin and, therefore, spray coating and spiral coating are preferred in order to form a photosensitive layer of a uniform thickness.

The photoreceptor, for which a polycarbonate resin having a weight average molecular weight of not less than 200,000 and preferably not more than 1,200,000 is used, is prepared by spray coating or spiral coating in accordance with the present invention.

The polycarbonate resin to be used, as described above, has one or more of the repeating units represented by the above formula [I]. Specific examples of the repeating units are given below. Of these, (17)–(27) comprise two kinds of repeating units and (28) and (29) three kinds of repeating units.

Of those, (17)–(27) contain 2 species of repeating units and (28) and (29) contain 3 species of repeating units of the formula [I].

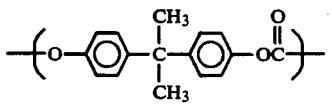

(1)

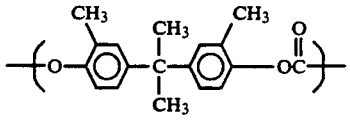

(2)

-continued
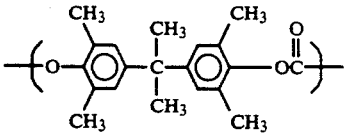
(3)
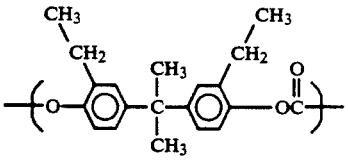
(4)
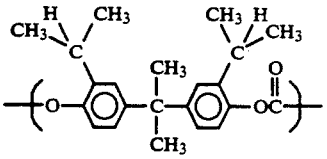
(5)
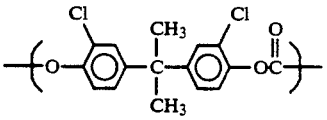
(6)
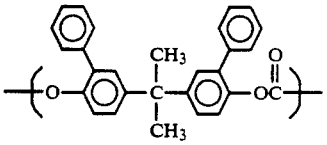
(7)
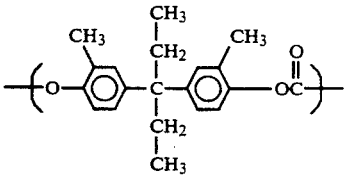
(8)
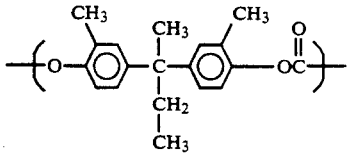
(9)
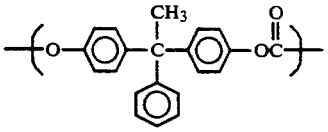
(10)
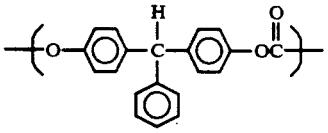
(11)
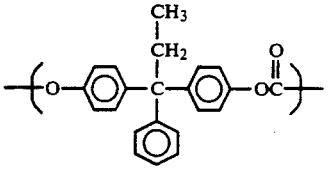
(12)

-continued
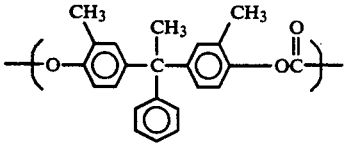
(13)
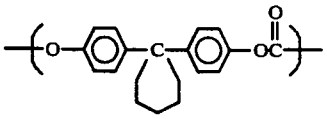
(14)
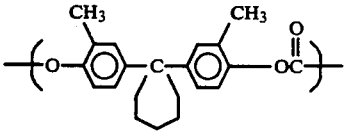
(15)
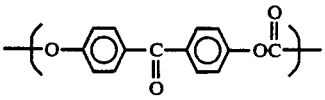
(16)
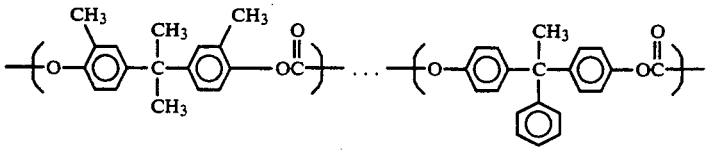
(17)
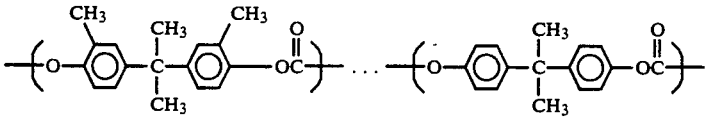
(18)
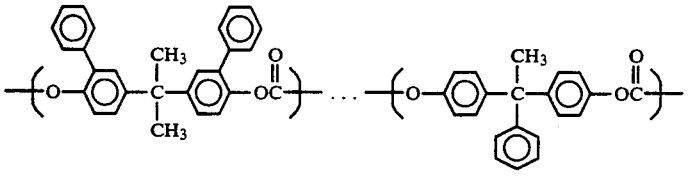
(19)
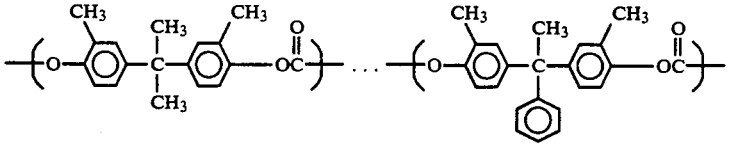
(20)
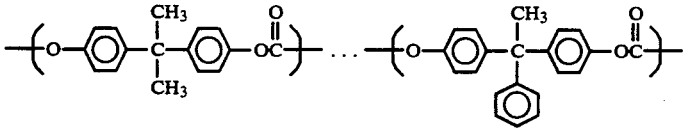
(21)
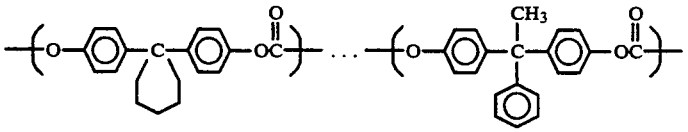
(22)
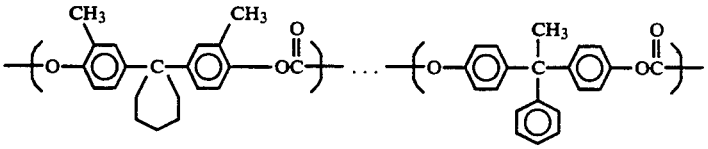
(23)

-continued

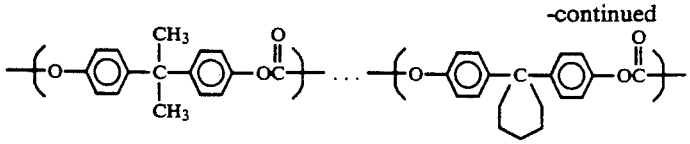
(24)

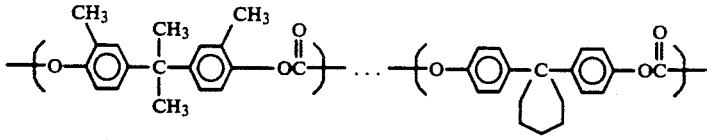
(25)

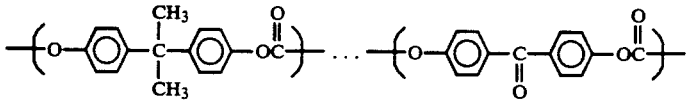
(26)

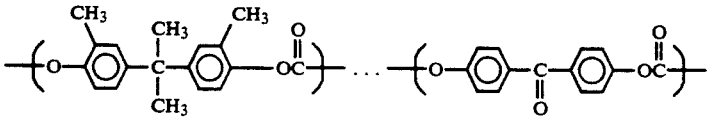
(27)

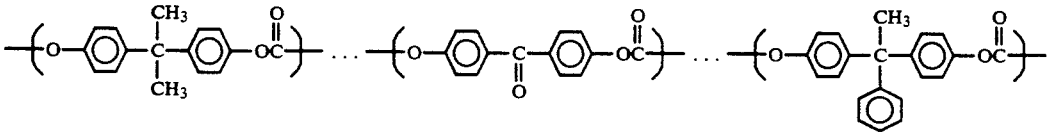
(28)

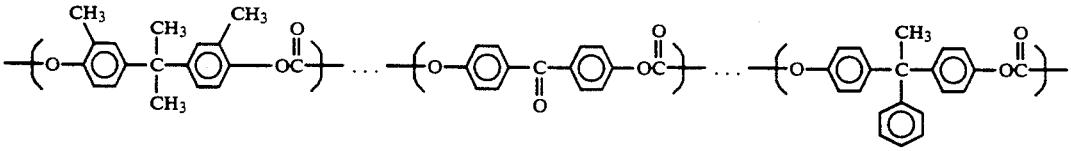
(29)

The polycarbonate resin used in the present invention can be prepared by using a bis-phenol compound represented by formula [II]

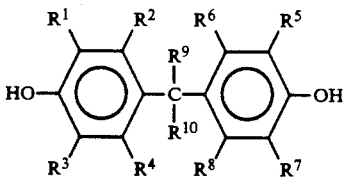
[II]

wherein $R^1$–$R^{10}$ are the same as described above. However, the molecular weight is higher than usual and, therefore, special measures to promote polymerization such as use of a catalyst or non-use of a polymerization terminator, etc. must be taken. The weight average molecular weight of the resulting polymer should not be more than 1,200,000 since preparation and handling of polymers of too high a molecular weight, which means high viscosity, are not easy. Preferred weight average molecular weight is 250,000 to 1,000,000 from the viewpoint of the effect of the invention and easiness of manufacturing electrophotographic photoreceptors.

When polycarbonate resins having a weight average molecular weight of not less than 200,000 is used, the photosensitive layer is formed preferably by spray coating or spiral coating.

The polycarbonate resin used in the present invention exhibit very excellent performance as a binder for photosensitive layers. Especially, when it is used as a charge transporting medium in combination with a charge transporting material, which is a photoconductive material, it gives a photosensitive layer having excellent durability.

Various types of photosensitive layer are known for photoreceptors. For instance, a photosensitive layer comprising a binder resin in which a charge transporting materal is dispersed and a dye as a sensitizer and an electron acceptor are added as desired; a photosensitive layer comprising a binder resin, in which photoconductive particles which generate charge carriers at high efficiency when they absorb light, and a charge transporting material is dispersed; a photosensitive layer consisting of a laminate of a charge generation layer comprising a binder resin in which photoconductive particles which generate charge carriers at high efficiency when they absorb light, and a charge transporting layer comprising a charge transporting material and a binder resin, etc. are known. The photosensitive layer of the photoreceptor in accordance with the present invention can be of any type. Especially, a photosensitive layer comprising a polycarbonate in accordance with the present invention as a binder, in which photoconductive particles, which generate charge carriers at high efficiency when they absorb light and a charge transporting material are dispersed and a dye and/or an electron acceptor are added as desired, and a photosensitive layer consisting of a laminate of a charge generation layer and a charge transporting layer which contains a polycarbonate resin binder in accordance with the present invention and is provided on the surface of the charge generation layer, are preferred.

The electrophotographic photoreceptor of the present invention can be prepared by mixing a polycarbonate resin having a weight average molecular weight of not less than 200,000 alone or in combination with one or more polymers which are known as excellent binders; dissolving them in a suitable solvent; adding photoconductive particles which generate charge carriers with very high efficiency when they absorb light, a sensitizing dye, an electron acceptor and other additives such as plasticizer, pigment, etc.; and applying the resulting coating liquid on the surface of an electroconductive support and drying it. When the photosensitive layer consisting of a charge generation layer and a charge transporting layer is employed, the photosensitive layer can be prepared by forming a charge transporting layer on a charge generation layer.

In order to form a layer of a uniform thickness using a coating liquid containing a polycarbonate resin having a weight average molecular weight of not less than 200,000 in accordance with the present invention, spray coating and spiral coating are suitable because it is possible by these methods to precisely apply a necessary amount of a coating liquid to required places and run (local flow) of the applied liquid is small.

Spray coating includes air spray, airless spray, electrostatic air spray, electrostatic airless spray, rotation misting electrostatic rotary atomizing spray, hot spray, hot airless spray, etc. When the fineness of particles to form a layer of a uniform thickness, adherence efficiency, etc. are considered, it is preferred to employ the electrostatic rotary atomizing spray, wherein carriage as disclosed in PCT Patent Application W089/05198 is employed, that is, rotating work cylinders, each having a support on each and, are carried continuously without spaces between two supports of the cylinders in the axial direction. By this method, an excellent electrophotographic photoreceptor having a photosensitive layer of a uniform thickness can be obtained at a high efficiency.

When a coating liquid containing a polycarbonate resin having a weight average molecular weight of not less than 200,000 is applied by spray coating, it is necessary to select a suitable solvent and coating conditions so that separation of the solids is not caused during spraying. That is, a solvent having a boiling point such that a suitable amount of the solvent will vaporize from the mist drops while they are flying or conditions as such must be selected. In the case where the solid content of the coating liquid must be reduced in order to reduce the viscosity of said liquid, that is, in the case of a coating liquid which gives thick wet coating, this method is excellent in uniformity of the thickness of coating film.

For spiral coating, a pouring coater or a curtain coater disclosed in Japanese Laying-Open Patent Publication No. 52-119651, a method disclosed in Japanese Laying-Open Patent Publication No. 1-231966, in which a coating liquid is ejected through a minute nozzle continuously as a thin stream, a multinozzle such as disclosed in Japanese Laying-Open Patent Publication No. 1-193161, etc. can be employed. In the method using a pouring coater or a curtain coater, spiral nonuniformity of thickness is easily caused. The solid content must be reduced in order to eject the coating liquid containing the polycarbonate resin in accordance with the present invention as a continuous stream instead of mist through a minute nozzle. When the solid content of a coating liquid is low, the resulting wet coating thickness is large, which will invite run. Vaporization of the solvent in the stream ejection cannot be expected as in the case of the flying mist drops. However, a multinozzle coater enables formation of a thick coating of a uniform thickness even with a highly viscous liquid and thus employment thereof is most suitable in the spiral coating for coating with a coating liquid containing the polycarbonate resin in accordance with the present invention.

Binders usable for the photosensitive layer other than the polycarbonate resin in the present invention are various polymers compatible with charge transporting materials, which include vinyl polymers and copolymers such as polystyrene, poly(vinyl acetate), poly(vinayl chloride), acrylic ester polymers, methacrylic ester polymers; polyvinylacetal, polycarbonate, polyesters, polysulfone, poly(phenylene oxide), polyurethane, cellulose esters, cellulose ethers, phenoxy resins, silicon resins, epoxy resins, etc.

The above-described binders are used preferably in an amount of not more than 100 parts per 100 parts of the polycarbonate resin in accordance with the present invention.

Examples of the charge transporting material are electron acceptor such as 2,4,6-trinitrofluorenone, tetracyanoquinodimethane, diphenoquinone derivatives; heterocyclic compounds such as carbazole, indole, imidazole, oxazole, thiazole, pyrazole, oxadiazole, pyrazoline, thiadiazole, etc.; aniline derivatives; hydrazone compounds, aromatic amine derivatives; stilbene derivatives or polymers having groups derived from the above compounds in the main or side chain thereof.

The binder is used usually in an amount of preferably 10–3000 parts, more preferably 50–1000 parts per 100 parts of the charge transporting material. The thickness of the charge transporting layer is usually 5 μm–60 μm, preferably 10 μm–45 μm.

The solid content of the coating liquid is usually 5–30 wt%. The viscosity of the coating liquid varies depending on the coating method but it is preferably 10–800 cps and more preferably 100–500 cps for spray coating and preferably 100–2000 cps and more preferably 200–1500 cps for spiral coating.

Examples of the solvent for preparing the coating liquid are ethers such as tetrahydrofuran, 1,4-dioxane, anisole, etc.; ketones such as methyl ethyl ketone, 2,4-pentanedione, cyclohexanone, etc.; aromatic hydrocarbons such as toluene, xylene, etc.; aprotic polar solvent such as N,N-dimethylformamide, acetonitrile, dimethyl sulfoxide, etc.; esters such as ethyl acetate, dimethyl malonate, etc.; ether esters such as methyl cellosolve acetate, 3-methoxybutyl acetate, propylene glycol methyl ether acetate, etc.; ketone ethers such as methyl acetoacetate, etc.; chlorinated hydrocarbons such as dichloroethane, chloroform, etc., all of which dissolve charge transporting materials. Of course, mixed solvents of two or more of these can be used for dissolving binders. Preferred solvents are tetrahydrofuran, 1,4-dioxane, anisole, 2,4-pentanedione, cyclohexanone, dimethyl malonate, methyl cellosolve acetate, 3-methoxybutyl acetate, propylene glycol methyl ether acetate and methyl acetoacetate, of which a suitable one or more are selected.

Any of known photoconductive particles, dyes and electron acceptors can be used for the photosensitive layer. Examples of photoconductive particles, which generate electric charge carriers at a high efficiency upon exposure to light, are particles of inorganic photoconductive substances such as selenium, selenium-tellurium alloys, selenium-arsenic alloys, cadmium sulfide, amorphous silicon, etc.; and organic photoconductive substances such as phthalocyanine pigments, perinone pigments, thioindigo, quinacridone, perylene pigments, anthraquinone pigments, azo pigments, bis-azo pigments, tris-azo pigments, tetrakis-azo pigments, cyanine pigments, squarilium pigments, etc. Examples of dyes are triphenyl methane dyes, thiazine dyes, quinone dyes, cyanine dyes, pyrylium salt, thiapyrylium salt, benzopyrylium salt, etc. Examples of electron acceptors are quinones, aldehydes, ketones, acid anhydride, cyano compounds, phthalides, etc. In the charge generation layer, a thin layer, which is formed by dissolving or dispersing any of the above-described binder resins, photoconductive particles and a charge transporting material, a dye, an electron acceptors, etc. if desired, in a solvent, applying the resulting coating liquid and drying, or a thin layer which is formed by vapor deposition of the above described photoconductive particles can be employed as a charge generation layer.

The photosensitive layer can contain any known plasticizer, anti-oxidant, UV absorber, leveling agent in order to improve film formation property, flexibility, applicability, mechanical strength, etc.

Needless to say, the thus formed photosensitive layer can further comprise an adhesive layer, an intermediate layer, a transparent insulating layer, etc. The electroconductive support, on which a photosensitive layer is to be formed, can be any of those which are now used. Specifically, a drum or a sheet of a metal such as aluminum, stainless steel, copper, etc., a laminate, vapor-deposition product of the above mentioned metals, etc., which are used in the art, as well as an electroconductive plastic film, a plastic drum, a paper sheet, a paper tube, etc. which is coated with an electroconductive layer comprising a binder and an electroconductive material such as a metal powder, carbon black, copper iodide, a polymer electrolyte, etc. Also, a sheet and a drum of a plastic which is made electroconductive by containing an electroconductive material such as a metal powder, carbon black, carbon fiber, etc.

The photoreceptor of the present invention is excellent in that fluctuation in sensitivity and charge acceptance is small, abrasion by cleaning blades is limited to minimum and seldom suffer from surface flaw which may influence the image of formed copies because of its excellent mechanical properties and thus has very good durability.

The polycarbonate resin is to be used in a photoreceptor in accordance with the present invention has excellent solubility in solvents. This exhibits high solubility even in a non-halogenated solvent such as 1,4-dioxane, tetrahydrofuran, 2,4-pentanedione, etc. and coating liquids can be prepared with these solvents, and, therefore, this resin is suitable from the hygienic viewpoint. The coating liquid prepared with this resin is very stable in storage and causes little defect in coating and, therefore, the productivity of the photoreceptors is enhanced.

Further, the process of the present invention gives photosensitive layers of uniform thickness even with a highly viscous coating liquid.

It is preferred that the scatter of dry film thickness of a cylindrical photoreceptor of the present invention is within ±5% when the thickness is measured at not less than 20 points at an equal interval in the aixial direction and at every 90° in the image area (the area used for formation of an image).

SPECIFIC DISCLOSURE OF THE INVENTION

Now the invention will be described in detail by way of preparation, working and comparative examples. However, the invention is not limited to these working examples only.

The term "parts" appearing in the following examples means "parts by weight".

PREPARATION 1

(a) Preparation of Polycarbonate Oligomer

| | |
|---|---|
| 2,2-bis(4-hydroxy phenyl)propane | 100 parts |
| Sodium hydroxide | 50 parts |
| Water | 680 parts |
| Methylene chloride | 330 parts |

The above were placed in a reactor equipped with a stirrer, which was rotated at 800 rpm. Seventy (70) parts of phosgene was blown into the mixture over a period of 40 minutes to cause the reaction. After the reaction was finished, the methylene chloride solution containing the formed oligomer was collected. The analysis thereof was as follows:

| | |
|---|---|
| Concentration of oligomer *1 | 28.6 wt % |
| Conc. of end chloroformate groups *2 | 1.17 N |
| Conc. of end phenolic hydroxy groups *3 | 0.12 N |

*1: Measured by evaporating the solvent to dryness.
*2: The sample was reacted with aniline and the resulting aniline hydrochloric acid salt was titrated with a 0.2 N sodium hydroxide aqueous solution.
*3: The sample was dissolved in an acetic acid solution of titanium tetrachloride and measured by colorimetric analysis at 546 nm.

(b) Preparation of the Polycarbonate Having Repeating Unit Formula (1)

| | |
|---|---|
| Polycarbonate oligomer sol'n obtained in (a) | 100 parts |
| Methylene chloride | 220 parts |

The above were placed in a reactor equipped with a stirrer, which was rotated at 800 rpm and an aqueous solution of:

| | |
|---|---|
| Sodium hydroxide | 9 parts |
| Triethylamine | 0.01 parts |
| Water | 70 parts |

was added and an interfacial polymerization was conducted for 30 minutes. Then 250 parts of methylene chloride was added and the interfacial polymerization was continued further for 2 hours and half. Thereafter, the reaction mixture was separated and the methylene chloride solution containing the polycarbonate was collected. The solution was washed with a sodium hydroxide aqueous solution, a hydrochloric acid aqueous solution and demineralized water and finally the methylene chloride was evaporated and the resin was collected. The weight average molecular weight of this resin was 507,300. The weight average molecular weight mentioned here means a molecular weight which was measured by gel permeation chromatography calibrated by monodisperse polystyrene standard.

PREPARATION 2

(a) Preparation of Polycarbonate Oligomer

| | |
|---|---|
| 2,2-bis(4-hydroxyphenyl)propane | 100 parts |
| Sodium hydroxide | 50 parts |
| Water | 680 parts |
| Methylene chloride | 330 parts |

The above were placed in a reactor equipped with a stirrer, which was rotated at 800 rpm. To this, 70 parts of phosgene was blown in over a period of 40 minutes. The analysis of the obtained methylene chloride solution of the oligomer was as follows:

| | |
|---|---|
| Oligomer concentration *1 | 28.4 wt % |
| Conc. of end chloroformate groups *2 | 1.24 N |
| Conc. of end phenolic hyroxyl groups *3 | 0.10 N |

*1: Measured after evaporated to dryness.
*2: The sample was reacted with aniline and the resulting aniline hydrochloride acid salt was titrated with a 0.2 N sodium hydroxide solution.
*3: The sample was dissolved in a mixed solution of methylene chloride, titanium tetrachloride and acetic acid and analyzed by colorimetric analysis at 546 nm.

(b) Preparation of the Polycarbonate Containing Repeating Units of Repeating Unit Formula (1)

| | |
|---|---|
| Oligomer solution obtained in (a) | 100 parts |
| Methylene chloride | 220 parts |

The above were placed in a reactor equipped with a stirrer, which was stirred at 800 rpm. Further an aqueous solution of

| | |
|---|---|
| Sodium hydroxide | 9 parts |
| Triethylamine | 0.01 parts |
| Water | 70 parts |

was added thereto and an interfactial polymerization was conducted for 30 minutes. Further 190 parts of methylene chloride was added to the reaction mixture and the reaction was allowed to continue for 2 hours and half. The reaction mixture was separated and the methylene chloride solution containing the polycarbonate resin was collected and washed with a sodium hydroxide aqueous solution, a hydrochloric acid aqueous solution and a demineralized water and finally the methylene chloride was evaporated and the polycarbonate resin was collected. The weight average molecular weight of the resin was 298,400. The term "weight average molecular weight" used herein means the molecular weight calibrated by monodisperse polystyrene standard, which was measured by the gel permeation chromatography.

EXAMPLE 1

Ten (10) parts of a bis-azo compound represented by a chemical formula (1) given below was added to 150 parts of 4-methoxy-4-methylpentanone-2 and the mixture was pulverized and dispersed in a sand-grinding mill.

The resulting pigment dispersion was added to a mixture of 100 parts of a 5% dimethoxyethane solution of poly(vinyl butyral) ("#6000-C" manufactured by Denki Kagaku Kogyo Kabushiki Kaisha) and 100 parts of a 5% solution of a phenoxy resin ("PKHH" (trade name) manufactured by Union Carbide Co.) and finally a dispersion containing 4.0% solids was prepared.

In the thus obtained dispersion an aluminum cylinder having a mirror-finished surface, an external diameter of 80 mm, a length of 348 mm and a thickness of 1.0 mm was dipped for coating so as to form a charge generation layer having a dry thickness of 0.4 g/m$^2$. Then an charge transporting layer was formed on the surface of the thus treated aluminum cylinder by applying a solution containing 95 parts of a hydrazone compound represented by the following chemical formula (2), 2.5 parts of a cyano compound represented by the following chemical formula (3) and 100 parts of the polycarbonate resin prepared in Preparation 1 having a weight average molecular weight of 507,300 in 100 parts of a dioxanetetrahydrofuran mixed solvent (solid content: 6.5%, viscosity: 200 cps) at a rate of 220 cm/min so as to form a charge transpoting layer having a dry thickness of 20 μm.

The thus obtained photoreceptor was designated Photoreceptor A.

(1)

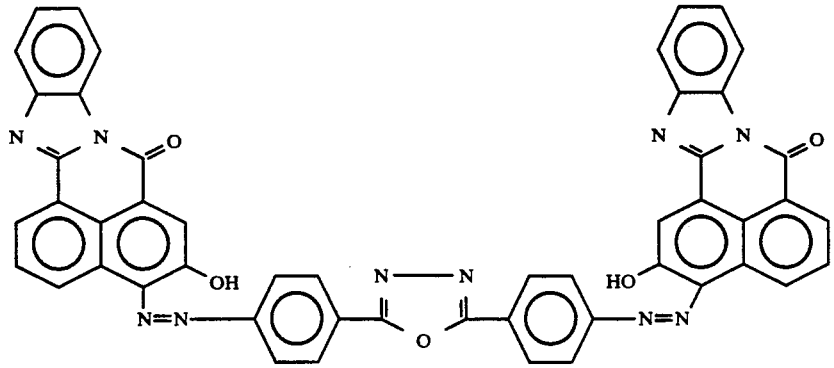

-continued (2)

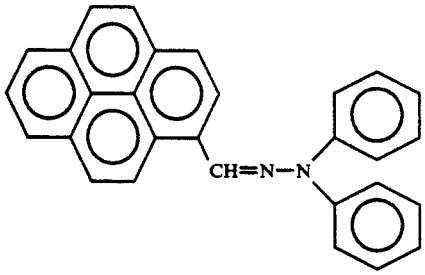

(3)

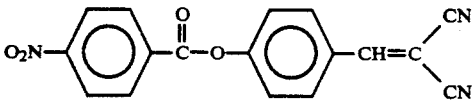

EXAMPLE 2

The procedures of Example 1 were repeated using a liquid containing a polycarbonate resin having a weight average molecular weight of 298,400 containing repeating units of repeating formula (1) (solid content: 9.3%, viscosity: 170 cps) for the charge transporting layer at a rate of 140 cm/min and a Photoreceptor B was prepared.

COMPARATIVE EXAMPLE 1

The procedures of Example 1 were repeated using a liquid containing a polycarbonate resin having a weight average molecular weight of 80,000 containing repeating units of repeating unit formula (1) (solid content: 22.3%, viscosity: 120 cps) for the charge transporting layer at a rate of 45 cm/min and a Photoreceptor C was prepared.

The above described photoreceptors were mounted on a copy machine ("SF8800" manufactured by Sharp Corporation) and a copying test was conducted, in which copying of 100,000 sheets was carried out. The results are shown in Table 1.

TABLE 1

| Photoreceptor | A | B | C |
|---|---|---|---|
| Initial thickness of photosensitive layer | 20.0 μm | 20.0 μm | 20.0 μm |
| Thickness of photosensitive layer after 100,000 copyings | 18.4 μm | 18.0 μm | 16.0 μm |

The measurement of the thickness of the photosensitive layers of Photoreceptors A, B and C was carried out with respect to the image area (the area used for formation of an image) at not less than 20 points at an equal interval in the axial direction at every 90°, that is, at not less than 80 points in all. It was revealed in Photoreceptor A that the intended thickness of 20 μm was attained at the position 150 mm from the upper end (the starting point of coating) because of run and there existed measurement points where the thickness was 70% of the intended thickness (−30%) in Photoreceptor A. The thickest point was 110% of the intended thickness (+10%). That is, the scatter of the thickness was −30% (70% of the intended thickness) and +10% (110% of the intended thickness) in the image area. In Photoreceptor B, the scatter of the thickness was −15% and +9%. In the copying test, evaluation was made in the area where the scatter of the film thickness was within ±10%. In Photoreceptor C, the degree of run was very small and the scatter of the thickness was ±5%.

It is apparent from Table 1 that the photoreceptor of the present invention has very excellent performance.

EXAMPLE 3

Ten (10) parts of the bis-azo compound represented by the chemical formula (1) used in Example 1 was added to 150 parts of 4-methoxy-4-methylpentanone-2 and the mixture was and dispersed in a sand grinding mill.

The resulting pigment dispersion was added to a mixture of 100 parts of a 5% 4-methoxy-4-methyl pentanone solution of polyvinylbutyral and 50 parts of a 10% 4-methoxy-4-methyl-pentanone solution of a phenoxy resin ("PKHH" (trade name) manufactured by Union Carbide Co.) and finally the solution was adjusted so that it contained 1.25% of solids.

The thus prepared dispersion was applied onto the surface of an aluminum cylinder having an external diameter of 80 mm, a length of 348 mm, a thickness of 1.0 mm and a mirror-finished surface by means of an electrostatic spray apparatus ("Grooved Mini-Bell" of Nippon Landsberg, Ltd. with a type J4 turbomotor ), of which the mini-bell having a diameter of 2 inches was rotated at 15,000 rpm. The dispersion was ejected at a rate of 11 ml/min and a charge generation layer having dry thickness of 0.4 g/m$^2$ was formed. The coating was carried out by holding the drum horizontally, rotating it at 200 rpm and translating it at a constant speed such that one drum was finished in 20 sec.

On the thus treated drum, a charge transporting layer was formed by ejecting a coating liquid prepared by dissolving 110 parts a hydrazone compound having chemical formula (2), which was used in Example 1, 2.5 parts of the cyano compound having chemical formula (3), which was used in Example 1, and 100 parts of polycarbonate resin having repeating units of repeating unit formula (1) having a weight average molecular weight of 298,400, which was prepared in Preparation 2 , in cyclohexanone so that the solid content was 8% (viscosity: 260 cps) onto the drum at 85 ml/min. Thus a charge transporting transfer layer having a thickness of 20 μm was formed.

The thus obtained photoreceptor was designated Photoreceptor D. The thickness of the photosensitive layer of Photorecptor D had a thickness of 20 μm at the point 10 mm from the starting end and the thickness fluctuation in the image area was ±2 μm.

COMPARATIVE EXAMPLE 2

Ten (10) parts of the bis-azo compound used in Example 3 was dispersed in 150 parts of 4-methoxy-4-methylpentanone-2 in a sand grinding mill.

Thus prepared dispersion was added to a mixture.of 100 parts of a 5% dimethoxyethane solution of polyvinylbutyral ("#6000-C" manufactured by Denki Kagaku Kogyo Kabushiki Kaisha) and 100 parts of a 5% dimethoxyethane solution of a phenoxy resin ("PKHH" (trade namem) manufactured by Union Carbide Co.) and finally a dispersion having a solid content of 4.0% and a viscosity of 2 cps, was obtained.

The thus obtained dispersion was applied to an aluminum cylinder having an external diameter of 80 mm, a length of 348 mm, a thickness of 1.0 mm and a mirror-finished surface by immersing it and raising at a rate of 40 cm/min. Thus a charge generation layer was formed.

Further, a charge transporting layer was formed on the thus formed charge generation layer by applying a liquid prepared by dissolving 110 parts of the hydrazone compound used in Example 1, 2.5 parts of the cyano compound and 100 parts of a polycarbonate resin having the repeating units of repeating unit formula (1) and a weight average molecular weight of 298,400 in a dioxane-tetrahydrofuran mixed solvent (solid content: 10% viscosity: 200 cps) onto the surface by immersing and raising at 120 cm/min. Thus a charge transporting layer having a dry thickness of 20 μm was formed.

The thus obtained photoreceptor was designated Photoreceptor E. The photosensitive layer of Photoreceptor E had a thickness of 20 μm at the point 90 mm from the upper end and scatter of the thickness was −14% and +5% in the image area.

EXAMPLE 4

A dispersion was prepared repeating the procedures of Example 3 except that the solid content of the used bis-azo compound was 2.0%. The dispersion was applied to an aluminum cylinder having an exterior diameter of 80 mm, a length of 348 mm, a thickness of 1.0 mm and a mirror-finished surface by ejection by means of an application multinozzle comprising 5 nozzles having an orifice diameter of 0.17 mm aligned at an interval of 0.85 mm, said 5 nozzles being arranged at an angle of 55.6° to the diametrical cross-section of the cylinder. The distance between the surface of the cylinder and the tip of the center nozzle of the multinozzle was 0.15 mm. The dispersion was ejected at a rate of 4.1 ml/min while the aluminum cylinder was rotated at 283 rpm and translated at a pitch of 2.3 mm/rotation. That is, the multinozzle was spirally moved relatively against the cylinder at a constant distance. Thus a charge generation layer having a dry thickness of 0.4 g/mm$^2$ was formed.

Further a solution was prepared by dissolving 110 parts of the hydrazone compound used in Example 3, 2.5 parts of the cyano compound and 100 parts of a polycarbonate resin having repeating units of repeating unit formula (2) and a weight average molecular weight of 273,600 in cyclohexane so as to give a solution having a solid content of 11% and a viscosity of 1150 cps. The solution was applied on the aluminum cylinder coated with a charge generation layer as described above by ejection by means of an application multinozzle comprising 4 nozzles having an orifice diameter of 0.4 mm aligned at an interval of 1.25 mm, said 4 nozzles being arranged at an angle of 61.3° to the axial direction of cylinder. The solution was ejected at a rate of 37 ml/min while the aluminum cylinder was rotated at 283 rpm and translated at a pitch of 2.3 mm/rotation. That is, the multinozzle was spirally moved relatively against the cylinder at a constant distance. Thus an electric charge transfer layer having a dry thickness of 20 μm was formed.

The thus obtained photoreceptor was designated Photoreceptor F. Photoreceptor F had a thickness of 20 μm at the point 20 mm from the starting end and the scatter of the thickness in the image area was ±2.5%.

COMPARATIVE EXAMPLE 3

In the same manner as in Comparative Example 2, a charge generation layer was formed on the same aluminum cylinder.

A liquid obtained by dissolving 110 parts of hydrazone compound used in Example 3, 2.5 parts of the cyano compound and a polycarbonate resin having repeating units of repeating unit formula (2) and a weight average molecular weight of 273,600 in a dioxane-tetrahydrofuran mixed solvent so as to have a solid content of 11% and a viscosity of 250 cps was applied to the above aluminum cylinder by immersing it in the liquid and raising at a rate of 80 cm/min. so that a charge transporting layer having a dry thickness of 20 μm was formed. The thus obtained photoreceptor was designated Photoreceptor G. The dry thickness was 20 μm at the point of 80 mm from the upper end (starting end of coating) and the scatter of the thickness was −12% and +5%.

It is apparent from comparison of Example 3 and Comparative Example 2 and the comparison of Example 4 and Comparative Example 3 that spray coating and spiral coating are superior to dip coating in that run, which is a problem in dip coating, seldom occur in the spray coating and the spiral coating and the uniformity of the resulting coating film is excellent.

COMPARATIVE EXAMPLE 4

The procedures of Comparative Example 2 was repeated and a charge generation layer was prepared.

Then a charge transporting layer was formed by applying a liquid obtained by dissolving 110 parts of the hydrazone compound used in Example 3, 2.5 parts of the cyano compound and 100 parts of a carbonate resin containing repeating units of repeating unit formula (2) and having a weight average molecular weight of 85,700 in a dioxane-tetrahydrofuran mixed solvent so as to form a liquid having the solid content of 24% and a viscosity of 130 cps by way of dip coating in which the raising rate was 40 cm/min. The thus obtained photoreceptor was designated Photoreceptor H. The scatter of the film thickness was ±4%.

EVALUATION

Photoreceptors F and H were mounted on a commercial copy machine ("SF9400" manufactured by Sharp Corporation) and a copying test was carried out, in which 100,000 sheets were copied. The results of the measurement of the layer thickness change by the test are shown in Table 2.

TABLE 2

| | Mw of carbonate | Abrasion of Layer (μm/100,000 sheets) |
|---|---|---|
| Photoreceptor H | 85,700 | 3.6 |
| Photoreceptor F | 273,600 | 3.0 |

COMPARATIVE EXAMPLE 5

The procedures of Comparative Example 4 were repeated using a polycarbonate resin having repeating units of repeating unit formula (1) and a weight average molecular weight of 80,000 and a Photoreceptor I was prepared. The scatter of the film thickness was ±5%.

EXAMPLE 5

The procedures of Example 3 were repeated using a polycarbonate resin having repeating units of repeating unit formula (1) and a weight average molecular weight of 357,900 and a Photoreceptor J was prepared. The scatter of the film thickness was ±4%.

EXAMPLE 6

The procedures of Example 3 were repeated using a polycarbonate resin having repeating units of repeating unit formula (1) and a weight average molecular weight of 583,700 and a Photoreceptor K was prepared. The scatter of the film thickness was ±4%.

EXAMPLE 7

The procedures of Example 3 were repeated using a polycarbonate resin having repeating units of repeating unit formula (1) and a weight average molecular weight of 730,900 and a Photoreceptor L was prepared. The scatter of the film thickness was ±5%.

EXAMPLE 8

The procedures of Example 3 were repeated using a polycarbonate resin having repeating units of repeating unit formula (1) and a weight average molecular weight of 1,003,000 and a Photoreceptor M was prepared. The scatter of the film thickness was ±5%.

EVALUATION

Photoreceptors I to M were mounted on a commercial copy machine ("SF9400" manufactured by Sharp Corporation) and a copying test was carried out, in which 100,000 sheets were copied. The results of the measurement of the layer thickness change by the test are shown in Table 3.

TABLE 3

| | Mw of carbonate | Abrasion of Layer (μm/100,000 sheets) |
|---|---|---|
| Photoreceptor I | 80,000 | 5.5 |
| Photoreceptor J | 357,900 | 3.8 |
| Photoreceptor K | 583,700 | 4.0 |
| Photoreceptor L | 730.000 | 1.7 |
| Photoreceptor M | 1,003,000 | 1.1 |

COMPARATIVE EXAMPLE 6

The procedures of Example 4 were repeated using a polycarbonate resin which had repeating units of repeating unit formula (17) and a weight average molecular weight of 177,500, wherein the ratio of the two structural units was 1:1 and the resulting photoreceptor was designated Photoreceptor N. The scatter of the film thickness was ±3%.

EXAMPLE 9

The procedures of Example 4 were repeated using a polycarbonate resin which has repeating units of repeating unit formula (17) and a weight average molecular weight of 336,800, wherein the ratio of the two structural units was 1:1 and the resulting photoreceptor was designated Photoreceptor O. The scatter of the film thickness was ±3%.

EXAMPLE 10

The procedures of Example 4 were repeated using a polycarbonate resin which has repeating units of repeating unit formula (17) and a weight average molecular weight of 455,900, wherein the ratio of the two structural units was 1:1 and the resulting photoreceptor was designated Photoreceptor P. The scatter of the film thickness was ±4%.

EVALUATION

Photoreceptors N to P were mounted on a commercial copying machine ("SF9400" manufactured by Sharp Corporation) and a copying test was carried out, in which 100,000 sheets were copied. The results of the measurement of the layer thickness before and after the test are shown in Table 4.

TABLE 4

| | Mw of carbonate | Abrasion of Layer (μm/100,000 sheets) |
|---|---|---|
| Photoreceptor N | 177,500 | 4.0 |
| Photoreceptor 0 | 336,800 | 2.4 |
| Photoreceptor P | 455,900 | 1.5 |

It is apparent from Tables 2, 3 and 4 that when polycarbonate resins having a weight average molecular weight not less than 200,000 was used as a binder, the abrasion of the layer was remarkably small.

What we claim is:

1. An electrophotographic photoreceptor comprising an electroconductive support and a photosensitive layer containing a photoconductive material and a binder resin, wherein said binder resin is a polycarbonate resin having a weight average molecular weight of not less than 200,000.

2. The electrophotographic photoreceptor claimed in claim 1, wherein said binder resin is a polycarbonate resin which contains structural repeating units represented by the formula

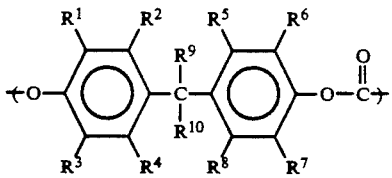

[I]

wherein $R^1$, $R^2$, $R^3$, $R^4$, $R^5$, $R^6$, $R^7$ and $R^8$ are respectively and independently a hydrogen atom, a lower alkyl group, a halogen atom or an unsubstituted or substituted aromatic group; and $R^9$ and $R^{10}$ are respectively and independently a hydrogen atom, a lower alkyl group, an unsubstituted and substituted aromatic group, or form a ring or a carbonyl group together with the linking carbon atom.

3. The electrophotographic photoreceptor as claimed in claim 2, wherein $R^1$, $R^2$, $R^3$, $R^4$, $R^5$, $R^6$, $R^7$ and $R^8$ are respectively and independently a hydrogen atom, a methyl group or a phenyl group and $R^9$ and $R^{10}$ are respectively and independently a hydrogen atom, a methyl group, a phenyl group or form a cyclohexane ring or a carbonyl group together with the linking carbon atom.

4. The electrophotographic photoreceptor as claimed in claim 2, wherein the photoconductive material is at least one selected from a group consisting of 2,4,6-trinitrofluorenone, tetracyanoquinodimethane, diphenoquinone derivatives; carbazole, imidazole, oxazole, thiazole, pyrazole, oxadiazole, pyrazoline, thiadiazole or aniline derivatives; a hydrazone derivatives; aromatic amine derivatives; stilbene derivatives; polymers which contain groups derived from one of these compounds in the main or side chain thereof selenium-tellurium alloys, selenium-arsenic alloys, cadmium sulfide, and amorphous silicon; phthalocyanine pigments, perinone pigments, thioindigo, quinacrilidone, perylene pigments, anthraquinone pigments, azo pigments, bis-azo pigments, tris-azo pigments, tetrakis-azo pigments, cyanine pigments, and squarilium pigments.

5. The electrophotographic photoreceptor as claimed in claim 2, wherein the photosensitive layer contains photoconductive particles, charge transporting material and a binder resin.

6. The electrophotographic photoreceptor as claimed in claim 1, wherein the photosensitive layer is a laminate of a charge generation layer and a charge transporting layer which is formed on said charge generation layer and contains particles, electric charge transporting material and a binder resin.

7. The electrophotographic photoreceptor as claimed in claim 1, wherein the photoreceptor body is cylindrical and the scatter of the film thickness is within ±5% when the thickness is measured at not less than 80 points which are located in the direction of the axis of the cylinder at an equal interval and at every 90° in the circumference.

8. In the method of preparation of a photoreceptor which comprises an electroconductive support and a photosensitive layer containing a photoconductive material and a binder resin, a method which is characterized in that the photosensitive layer contains a polycarbonate having a weight average molecular weight of not less than 200,000 as a binder resin and is formed by spray coating or spiral coating.

9. The method of preparation of a photoreceptor as claimed in claim 8, wherein the binder resin is a polycarbonate resin which contains structural repeating units as represented by a formula

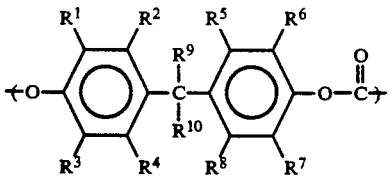

[I]

wherein $R^1$, $R^2$, $R^3$, $R^4$, $R^5$, $R^6$, $R^7$ and $R^8$ are respectively and independently a hydrogen atom, a lower alkyl group, a halogen atom or an unsubstituted or substituted aromatic group; and $R^9$ and $R^{10}$ are respectively and independently a hydrogen atom, a lower alkyl group, an unsubstituted or substituted aromatic group, or form a ring or a carbonyl group together with the linking carbon atom.

10. The method of preparation of a photoreceptor as claimed in claim 8, wherein the polycarbonate resin has a weight average molecular weight of not less than 200,000 and not more than 1,200,000.

11. The method of preparation of a photoreceptor as claimed in claim 8, wherein the polycarbonate resin has a weight average molecular weight of not less than 250,000 and not more than 1,000,000.

12. The method of preparation of a photoreceptor as claimed in claim 9, wherein $R^1$, $R^2$, $R^3$, $R^4$, $R^5$, $R^6$, $R^7$ and $R^8$ are respectively and independently a hydrogen atom, a methyl group or a phenyl group and $R^9$ and $R^{10}$ are respectively and independently a hydrogen atom, a methyl group, a phenyl group or form a cyclohexane ring or a carbonyl group together with the linking carbon atom.

13. The method of preparation of a photoreceptor as claimed in claim 8, wherein the photoconductive material is at least one selected from a group consisting of 2,4,6-trinitrofluorenone, tetracyanoquinodimethane, diphenoquinone derivatives, carbazole, indole, imidazole, oxazole, pyrazole, oxadiazole, pyrazoline, thiadiazole, aniline derivatives, hydrazone compounds, aromatic amine derivatives, stilbene derivatives, polymers having groups derived from the above compounds in the main or side chain thereof; selenium-tellurium alloys, selenium-arsenic alloys, cadmium sulfide, and amorphous silicon; phthalocyanine pigments, perinone pigments, thioindigo, quinacrilidone, perylene pigments, anthraquinone pigments, azo pigments, bis-azo pigments, tris-azo pigments, tetrakis-azo pigments, cyanine pigments, and squarilium pigments.

14. The method of preparation of a photoreceptor as claimed in claim 8, wherein the photosensitive layer comprises a photosensitive layer containing photoconductive particles, a charge transporting material and a binder resin.

15. The method of preparation of a photoreceptor as claimed in claim 8, wherein the photosensitive layer comprises a laminate of a charge generation layer and a charge transporting layer formed on the former and containing a charge transporting material and a binder resin.

16. The method of preparation of a photoreceptor as claimed in claim 8, wherein the photoreceptor is cylindrical and the scatter of the film thickness is within ±5% when the thickess is measured at not less than 80 points which are located in the direction of axis of the cylinder at an equal interval and at every 90° in the circumference.

* * * * *